US012138522B2

(12) United States Patent
Long et al.

(10) Patent No.: US 12,138,522 B2
(45) Date of Patent: Nov. 12, 2024

(54) PROTECTIVE FIELD SCREEN

(71) Applicant: Phil Pulley, St. Petersburg, FL (US)

(72) Inventors: Warren Long, Little Rock, AR (US); Zachary Crowl, Little Rock, AR (US); Jerry Duncan, Little Rock, AR (US); Brad Foree, Little Rock, AR (US); Cliff Ryan, Little Rock, AR (US); Randel Davis, Little Rock, AR (US); Ryland Keiffer, Little Rock, AR (US)

(73) Assignee: Phil Pulley, St. Petersburg, FL (US)

( * ) Notice: Subject to any disclaimer, the term of this patent is extended or adjusted under 35 U.S.C. 154(b) by 0 days.

(21) Appl. No.: 18/344,390

(22) Filed: Jun. 29, 2023

(65) Prior Publication Data

US 2023/0338813 A1 Oct. 26, 2023

Related U.S. Application Data

(63) Continuation of application No. 17/538,256, filed on Nov. 30, 2021, now Pat. No. 11,731,024, which is a continuation-in-part of application No. 17/404,582, filed on Aug. 17, 2021, now Pat. No. 11,617,933.

(51) Int. Cl.
*A63B 69/00* (2006.01)
*A63B 71/02* (2006.01)

(52) U.S. Cl.
CPC ..... *A63B 71/022* (2013.01); *A63B 69/0002* (2013.01); *A63B 69/0097* (2013.01); *A63B 2069/0006* (2013.01); *A63B 2210/50* (2013.01)

(58) Field of Classification Search
CPC ..... A63B 69/0002; A63B 2069/0006; A63B 69/0097; A63B 71/022
USPC ..... 473/446, 422
See application file for complete search history.

(56) References Cited

U.S. PATENT DOCUMENTS

| | | | |
|---|---|---|---|
| 3,979,120 | A | 9/1976 | Dietrich |
| 5,083,774 | A | 1/1992 | Yalvac |
| 5,118,103 | A | 6/1992 | Miller |
| 5,437,590 | A | 8/1995 | D'Alto |
| 5,511,775 | A | 4/1996 | Parks |
| 5,553,863 | A | 9/1996 | Wynne |
| 5,722,905 | A | 3/1998 | Bidelman |
| 6,354,968 | B1 | 3/2002 | Nozato |

(Continued)

FOREIGN PATENT DOCUMENTS

| | | | |
|---|---|---|---|
| EP | 2277608 | A1 | 1/2011 |
| KR | 102269948 | B1 | 6/2021 |
| WO | 2023022967 | A1 | 2/2023 |

OTHER PUBLICATIONS

Notice of Allowance issued in U.S. Appl. No. 17/404,582, dated Jan. 19, 2023, pp. 1-7.

(Continued)

*Primary Examiner* — Mitra Aryanpour
(74) *Attorney, Agent, or Firm* — Pillsbury Winthrop Shaw Pittman, LLP

(57) ABSTRACT

A field screen system that includes a screen frame system including a screen frame and a screen coupled to the screen frame, a base frame configured to be disposed on a supporting surface, and resilient members. The screen frame coupled to the base frame by way of the resilient members, and the resilient members configured to deform to enable movement of the screen frame relative to the base frame.

22 Claims, 9 Drawing Sheets

(56) References Cited

U.S. PATENT DOCUMENTS

| | | | | |
|---|---|---|---|---|
| 6,851,661 | B1 | 2/2005 | Penning | |
| 7,198,580 | B2 | 4/2007 | Elder et al. | |
| 9,011,278 | B2 | 4/2015 | Lay | |
| 11,617,933 | B2 | 4/2023 | Long et al. | |
| 11,731,024 | B2 * | 8/2023 | Long ..... | A63B 71/022 473/422 |
| 2007/0049428 | A1 | 3/2007 | Stromsborg | |
| 2007/0066423 | A1 | 3/2007 | Morrow | |
| 2011/0195804 | A1 | 8/2011 | Hixon et al. | |
| 2017/0216702 | A1 | 8/2017 | Valle | |
| 2023/0055836 | A1 | 2/2023 | Long et al. | |
| 2023/0059727 | A1 | 2/2023 | Long et al. | |

OTHER PUBLICATIONS

International Search Report & Written Opinion in PCT/US2022/040304, dated Nov. 29, 2022, pp. 1-12.
Office Action for U.S. Appl. No. 17/404,582, dated Sep. 16, 2022, pp. 1-11.
International Preliminary Report on Patentability in PCT/US2022/040304, dated Feb. 29, 2024, pp. 1-8.

* cited by examiner

PROTECTIVE FIELD SCREEN

RELATED APPLICATIONS

This application is a continuation of U.S. patent application Ser. No. 17/538,256 filed Nov. 30, 2021 and titled "Protective Field Screen", which is a continuation-in-part of U.S. patent application Ser. No. 17/404,582 filed Aug. 17, 2021 and titled "Protective Field Screen", which are hereby incorporated by reference.

This application is related to International Patent Application PCT/US2022/40304 filed Aug. 15, 2022 and titled "Protective Field Screen", the entirety of which is hereby incorporated by reference.

FIELD

Embodiments relate generally to protective sports equipment and more particularly to protective field screens.

BACKGROUND

Protective field screens are often used in ball sports, such as baseball, football, golf, soccer or lacrosse, to protect individuals and equipment from being struck by balls. In the sport of baseball, for example, a "pitching screen" may be placed between a pitcher and a batter to protect the pitcher from balls struck by the batter. Similar types of protective field screens can be placed in front of other players or equipment to protect them from balls or other objects.

SUMMARY

Protective field screens can enhance safety of persons and equipment. Unfortunately, existing protective field screens have shortcomings. For example, protective field screens are typically formed of netting strung about a frame, and, although the netting may absorb impacts of balls that strike the net, balls that strike the frame may damage the frame or deflect off the frame and strike persons or equipment.

Provided are embodiments of a protective field screen (or "field screen") having in impact absorption system (or "dampening system"). In some embodiments, the dampening system includes one or more resilient members disposed between a base frame (e.g., a lower frame portion of the field screen that rest on the ground or other supporting surface) and screen frame (e.g., an upper frame portion of the field screen that supports a protective netting). For example, the screen frame may be coupled to the base frame by way of resilient members. In such an embodiment, the resilient members may deform to facilitate movement (e.g., pivoting) of the screen frame (and the protective netting) relative to the base frame. The movement may provide dampening that enhances the field screen's ability to absorb impacts, which can, in turn, enhance durability and protection offered by the field screen. For example, with regard to durability, the enhanced dampening of impacts to the frame may inhibit denting, cracking or breaking of the frame. With regard to protection, the enhanced dampening of impacts to the frame (or the protective netting) may help to absorb the energy of a moving (or "flying") ball such that the ball stops and "falls down" to a foot of the field screen or deflects off the field screen at a relatively low speed.

Provided in some embodiments, is a protective field screen system that includes: a screen frame system including: a screen frame; and a protective screen including a netting coupled to the screen frame; a base frame adapted to be disposed on a supporting surface; and resilient members, the screen frame coupled to the base frame by way of the resilient members, and the resilient members adapted to deform to enable movement of the screen frame relative to the base frame. In some embodiments, the screen frame includes: a planar screen frame adapted to support the netting of the protective screen; and a screen frame arm member oriented transverse to the planar screen frame, and a resilient member of the resilient members is disposed between the screen frame arm member and the base frame. In certain embodiments, the screen frame includes: a planar screen frame adapted to support the netting of the protective screen; a first screen frame arm member oriented transverse to the planar screen frame, the first screen frame arm member including a first portion that extends on a first side of the planar screen frame and a second portion that extends on a second side of the planar screen frame; and a second screen frame arm member oriented transverse to the planar screen frame, the second screen frame arm member including a first portion that extends on the first side of the planar screen frame and a second portion that extends on the second side of the planar screen frame; the base frame includes: a first base frame foot member oriented transverse to the planar screen frame, the first base frame foot member including a first portion that extends on the first side of the planar screen frame and a second portion that extends on the second side of the planar screen frame; and a second base frame foot member oriented transverse to the planar screen frame, the second base frame foot member including a first portion that extends on the first side of the planar screen frame and a second portion that extends on the second side of the planar screen frame, a first resilient member of the resilient members is disposed between the first portion of the first screen frame arm member and the first portion of the first base frame foot member, a second resilient member of the resilient members is disposed between the second portion of the first screen frame arm member and the second portion of the first base frame foot member, a third resilient member of the resilient members is disposed between the first portion of the second screen frame arm member and the first portion of the second base frame foot member, and a fourth resilient member of the resilient members is disposed between the second portion of the second screen frame arm member and the second portion of the second base frame foot member. In some embodiments, the resilient members are adapted to deform to enable pivoting of the screen frame relative to the base frame. In certain embodiments, each of the resilient members is formed of an elastomeric material. In some embodiments, each of the resilient members includes a hollow, oval-shaped member formed of an elastomeric material. In certain embodiments, the netting includes a flexible mesh. In some embodiments, the screen frame defines an opening that is covered by the netting of the protective screen. In certain embodiments, the screen frame includes an L-shaped screen frame that defines an L-shaped opening that is covered by the netting of the protective screen. In some embodiments, the screen frame includes a rectangular shaped screen frame that defines rectangular opening that is covered by the netting of the protective screen. In some embodiments, the base frame includes base frame foot members having recesses, where the resilient members are disposed in the recesses and secured to the base frame foot member. In certain embodiments, each of the base frame foot members comprise hollow tubing, where each of the recesses is defined by a cutout formed in an upper wall of the hollow tubing, and each of the resilient members is disposed in a respective void region exposed by a respective cutout formed in the upper wall of the hollow tubing and is secured to a lower wall of the tubing exposed by the respective cutout.

Provided in some embodiments is a protective field screen system that includes: a screen frame system including a screen frame adapted to support a protective screen including a netting adapted to be coupled to the screen frame; a base frame adapted to be disposed on a supporting surface; and resilient members adapted to couple the screen frame to the base frame, the resilient members adapted to deform to enable movement of the screen frame relative to the base frame.

In some embodiments, the screen frame includes: a planar screen frame adapted to support the netting of the protective screen; and a screen frame arm member oriented transverse to the planar screen frame, and a resilient member of the resilient members is disposed between the screen frame arm member and the base frame. In certain embodiments, the screen frame includes: a planar screen frame adapted to support the netting of the protective screen; a first screen frame arm member oriented transverse to the planar screen frame, the first screen frame arm member including a first portion that is adapted to extend on a first side of the planar screen frame and a second portion that is adapted to extend on a second side of the planar screen frame; and a second screen frame arm member oriented transverse to the planar screen frame, the second screen frame arm member including a first portion that is adapted to extend on the first side of the planar screen frame and a second portion that is adapted to extend on the second side of the planar screen frame; the base frame includes: a first base frame foot member oriented transverse to the planar screen frame, the first base frame foot member including a first portion that is adapted to extend on the first side of the planar screen frame and a second portion that is adapted to extend on the second side of the planar screen frame; and a second base frame foot member oriented transverse to the planar screen frame, the second base frame foot member including a first portion that is adapted to extend on the first side of the planar screen frame and a second portion that is adapted to extend on the second side of the planar screen frame, a first resilient member of the resilient members is adapted to be disposed between the first portion of the first screen frame arm member and the first portion of the first base frame foot member, a second resilient member of the resilient members is adapted to be disposed between the second portion of the first screen frame arm member and the second portion of the first base frame foot member, a third resilient member of the resilient members is adapted to be disposed between the first portion of the second screen frame arm member and the first portion of the second base frame foot member, and a fourth resilient member of the resilient members is adapted to be disposed between the second portion of the second screen frame arm member and the second portion of the second base frame foot member. In some embodiments, the resilient members are adapted to deform to enable pivoting of the screen frame relative to the base frame. In certain embodiments, each of the resilient members is formed of an elastomeric material. In some embodiments, each of the resilient members includes a hollow, oval-shaped member formed of an elastomeric material. In certain embodiments, the netting includes a flexible mesh. In some embodiments, the screen frame defines an opening that is adapted to be covered by the netting of the protective screen. In certain embodiments, the screen frame includes an L-shaped screen frame that defines an L-shaped opening that is adapted to be covered by the netting of the protective screen. In some embodiments, the screen frame includes a rectangular shaped screen frame that defines rectangular opening that is adapted to be covered by the netting of the protective screen.

Figure 1A:
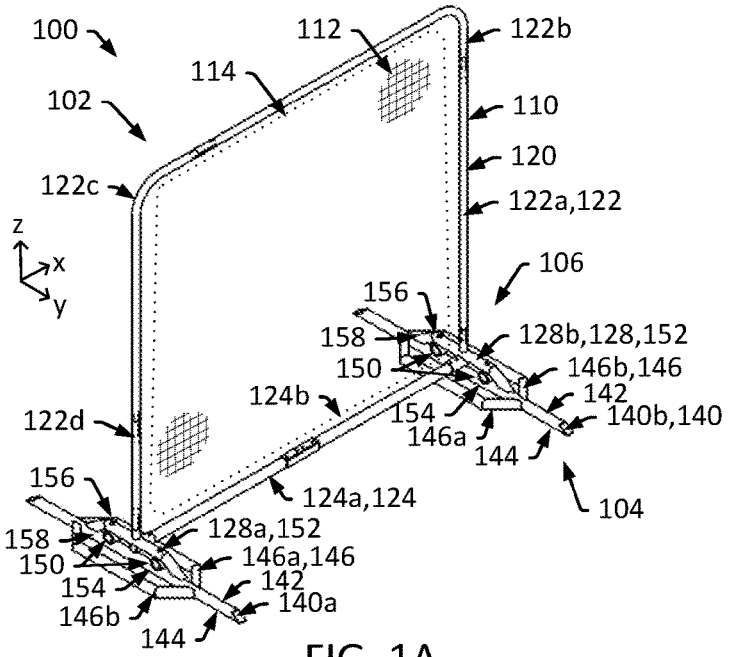
FIGS. 1A-F are diagrams that illustrate a rectangular-type protective field screen system in accordance with one or more embodiments.
Figure 1D:
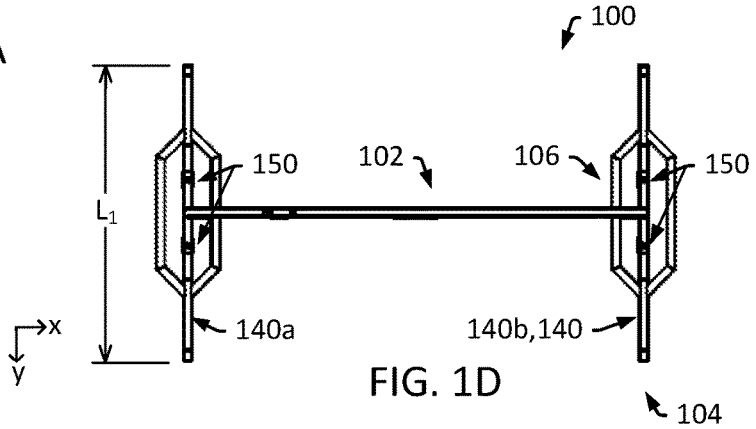
Figure 1B:
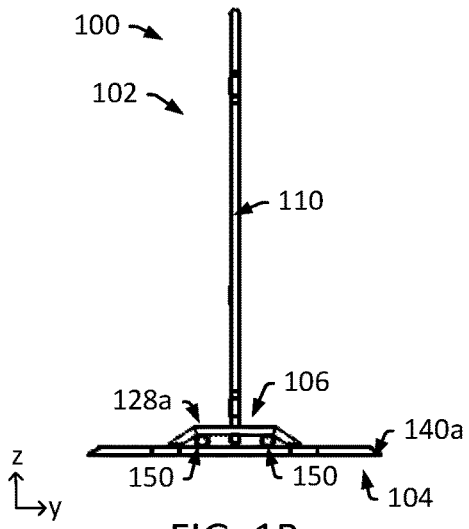
Figure 1C:
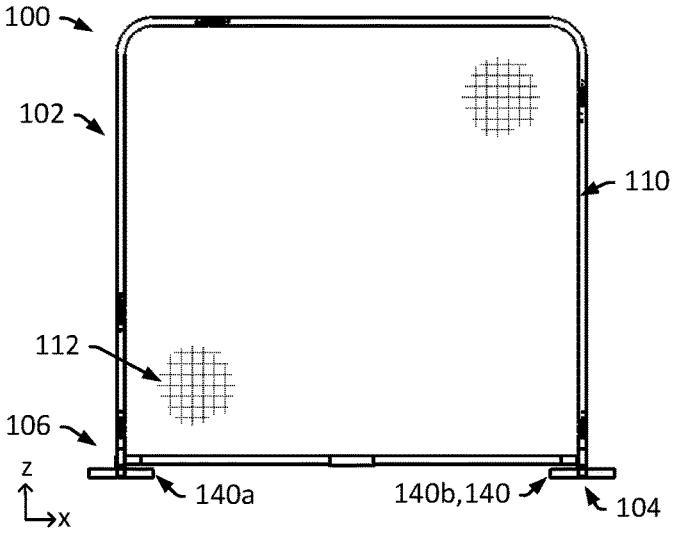

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents and alternatives falling within the spirit and scope of the present disclosure as defined by the claims.

DETAILED DESCRIPTION

Provided are embodiments of a protective field screen (or "field screen") having in impact absorption system (or "dampening system"). In some embodiments, the dampening system includes one or more resilient members disposed between a base frame (e.g., a lower frame portion of the field screen that rest on the ground or other supporting surface) and screen frame (e.g., an upper frame portion of the field screen that supports a protective netting). For example, the screen frame may be coupled to the base frame by way of resilient members. In such an embodiment, the resilient members may deform to facilitate movement (e.g., pivoting) of the screen frame (and the protective netting) relative to the base frame. The movement may provide dampening that enhances the field screen's ability to absorb impacts, which can, in turn, enhance durability and protection offered by the field screen. For example, with regard to durability, the enhanced dampening of impacts to the frame may inhibit denting, cracking or breaking of the frame. With regard to protection, the enhanced dampening of impacts to the frame (or the protective netting) may help to absorb the energy of a moving (or "flying") ball such the ball stops and "falls down" to a foot of the field screen or deflects off the field screen at a relatively low speed.

Figure 1E:
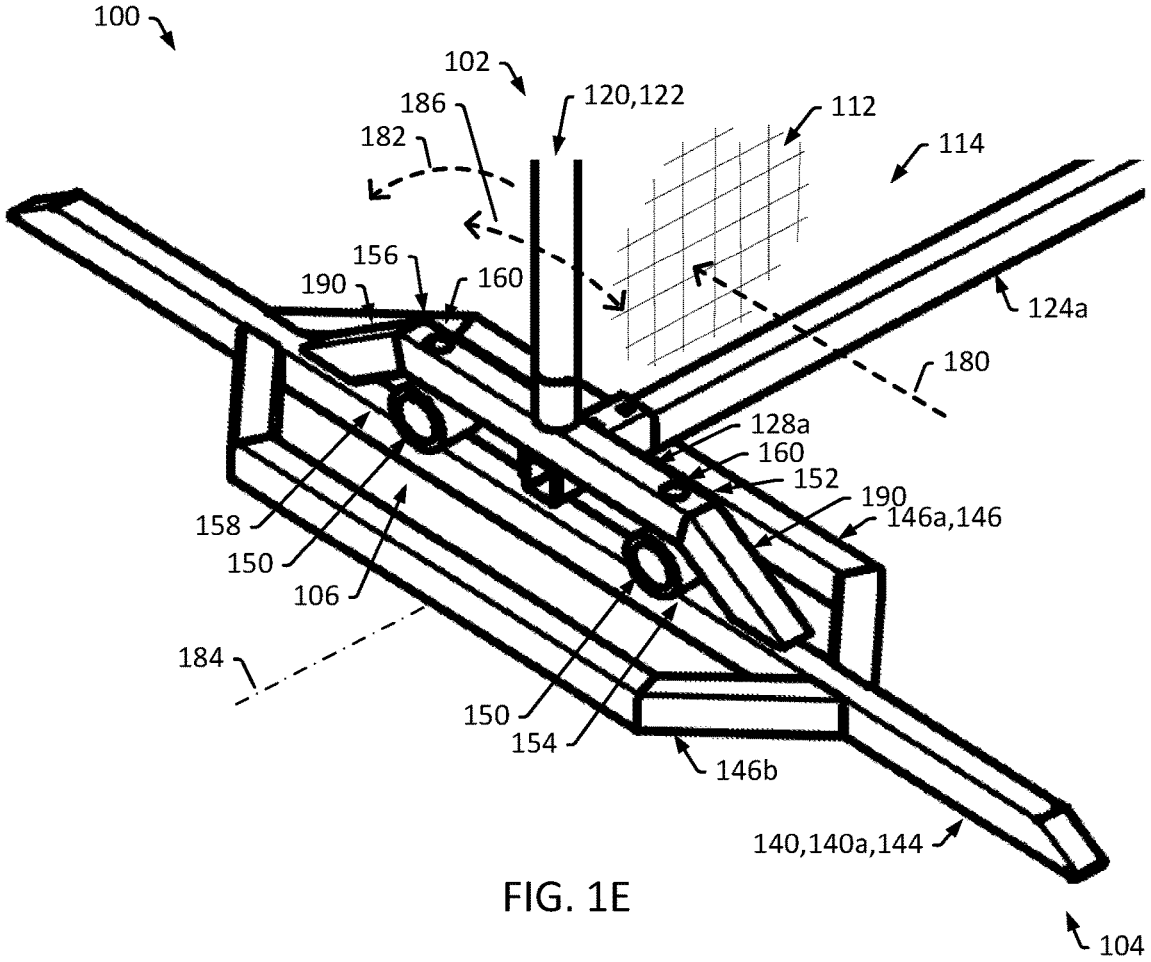
Figure 1F:
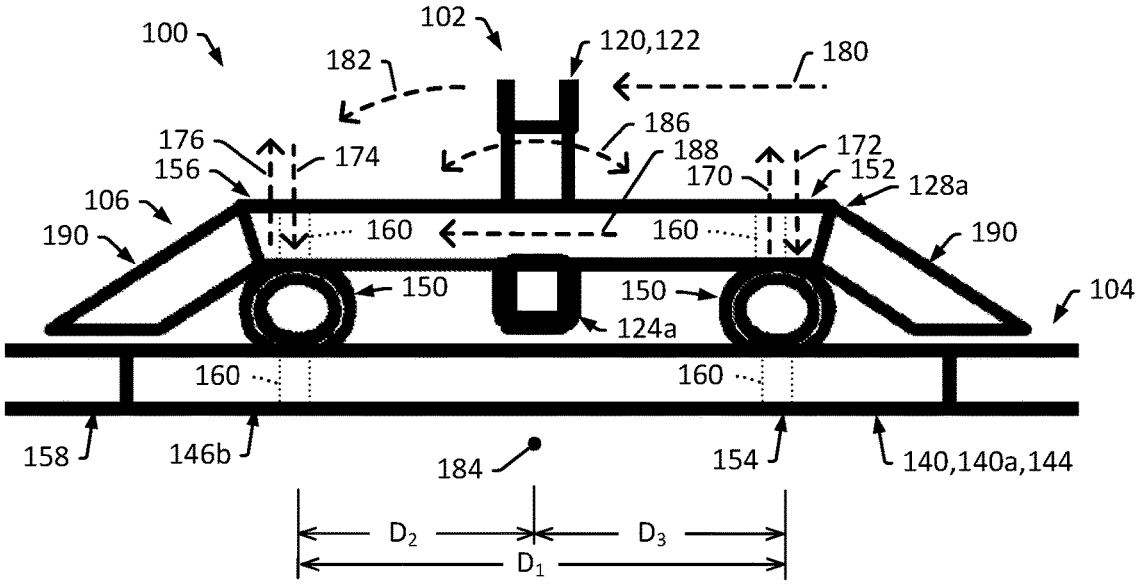
Figure 2A:
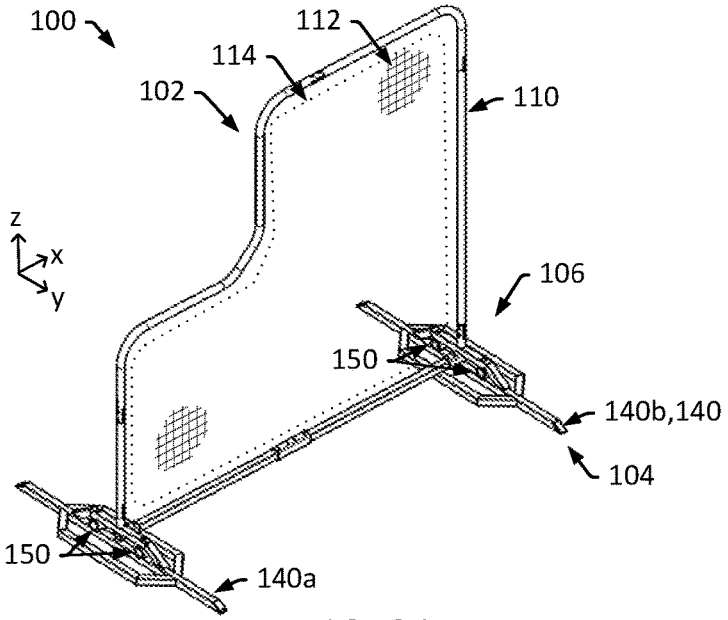
FIGS. 2A-3F are diagrams that illustrate L-type protective field screen systems in accordance with one or more embodiments.
Figure 2D:
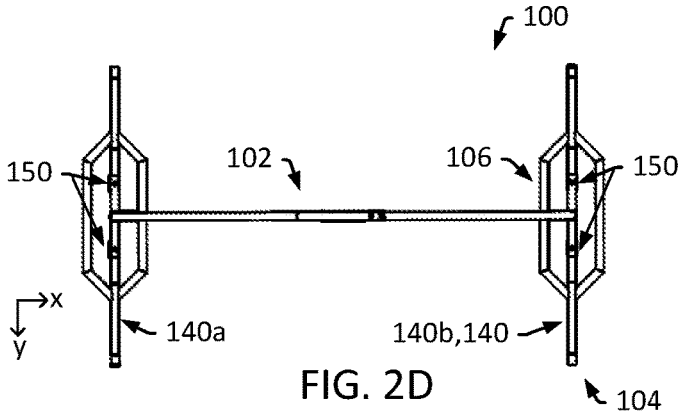
Figure 2B:
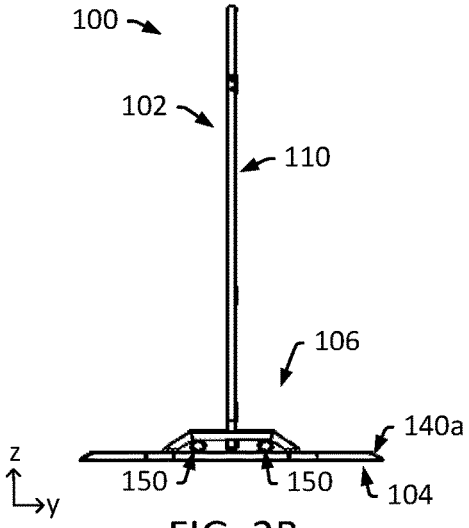
Figure 2C:
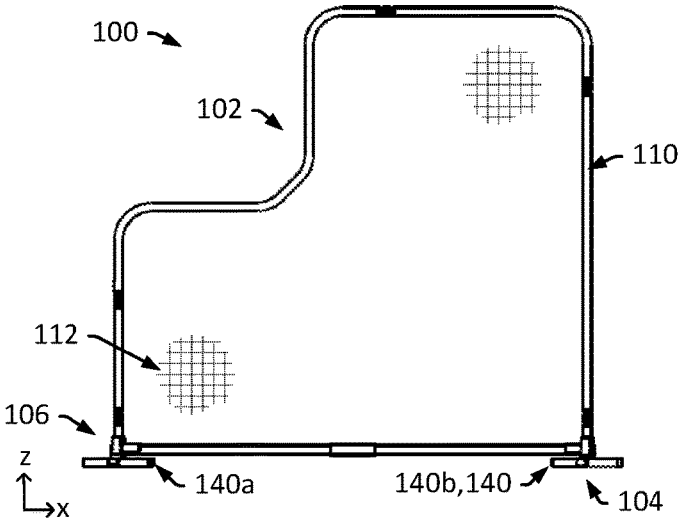
Figure 3A:
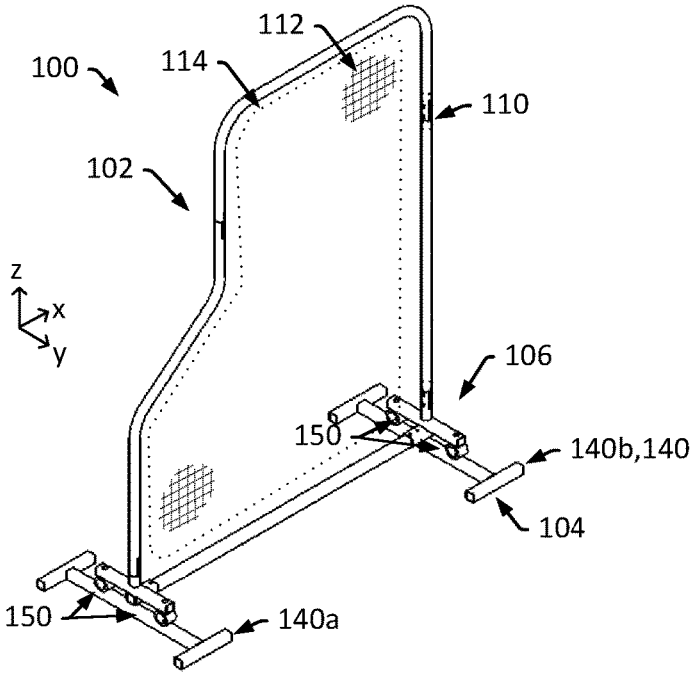
Figure 3D:
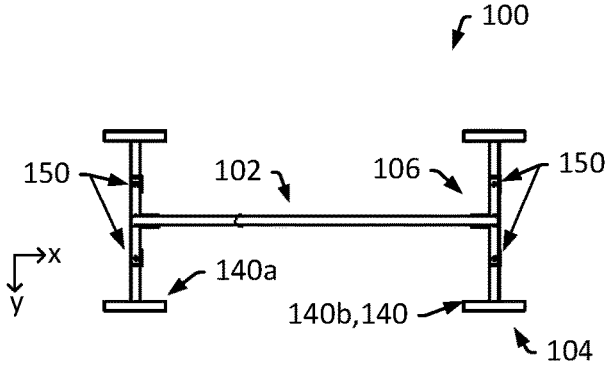
Figure 3B:
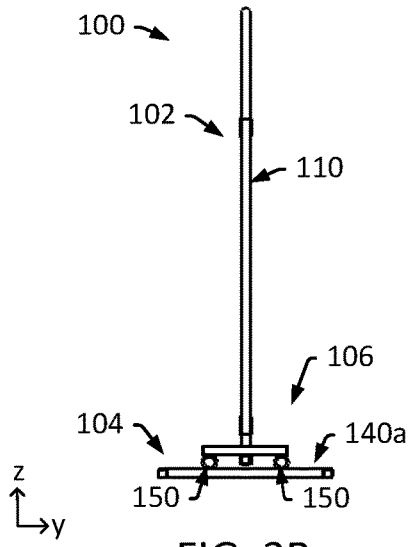
Figure 3C:
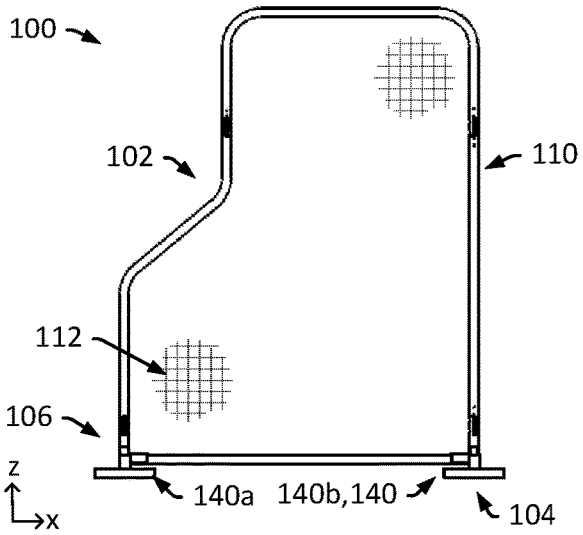
Figure 3E:
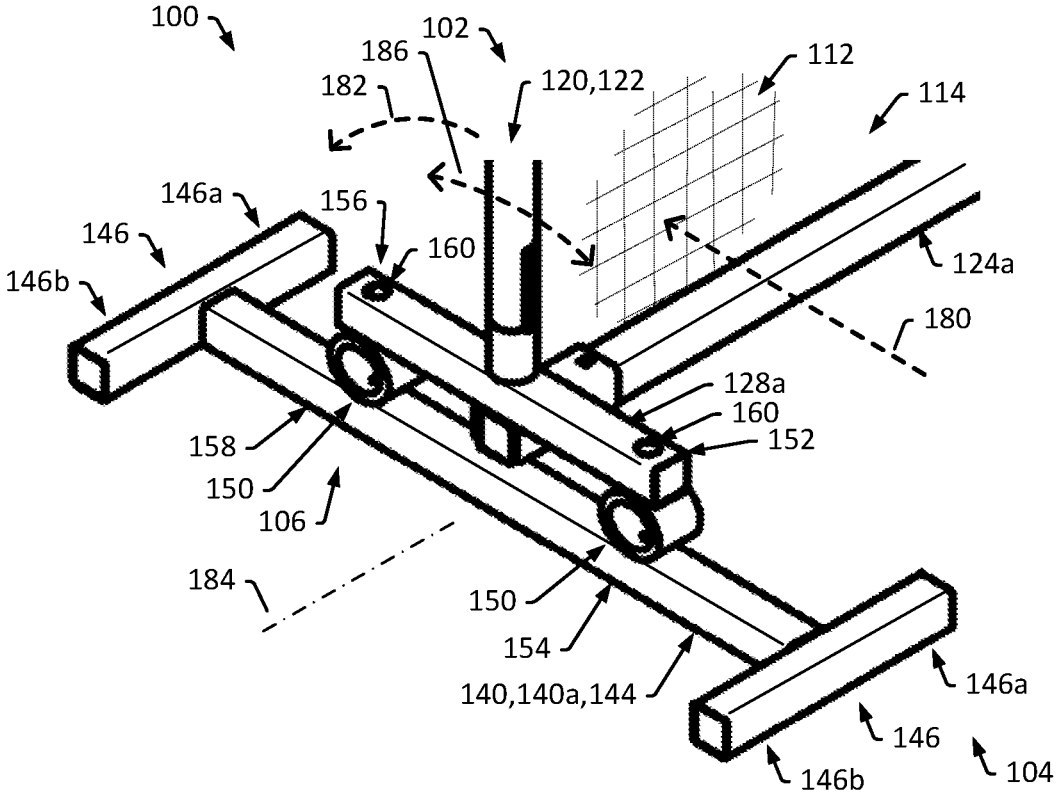
Figure 3F:
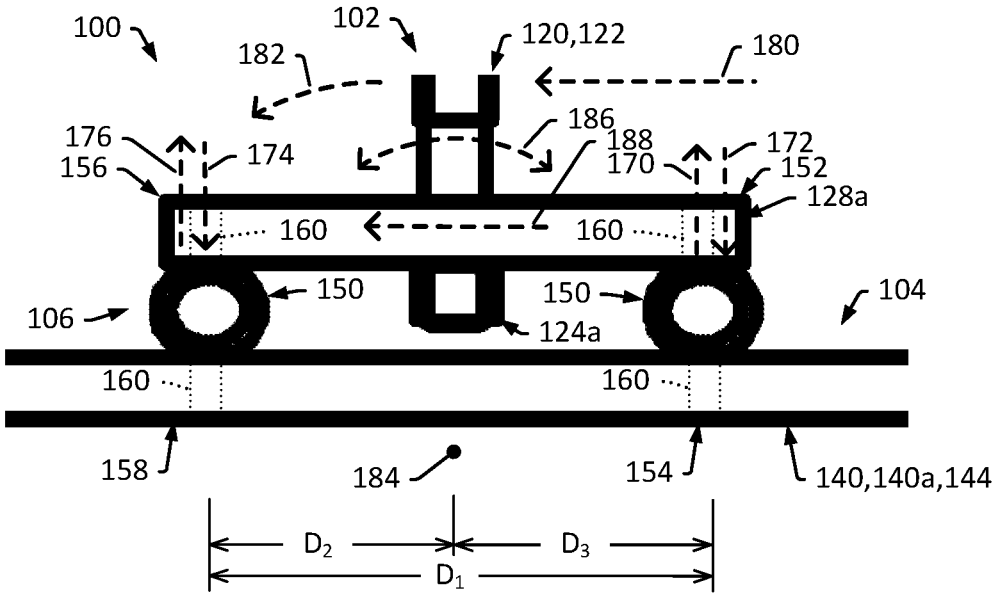

FIGS. 1A-1D are diagrams that illustrate respective isometric, side, front and top views of a protective field screen system (or "field screen") 100 in accordance with one or more embodiments. In some embodiments, the field screen 100 includes a first/upper frame system (or "screen frame system") 102, a second/lower frame system (or "base frame system") 104, and a frame dampening system (or "dampening system") 106. FIGS. 1E and 1F are diagrams that illustrate detailed perspective and side views, respectively, of a right side of the field screen 100 of FIGS. 1A-1D, including details of the described frame dampening system 106. As described here, the frame dampening system 106 may facilitate movement (e.g., pivoting) of the screen frame system 102 relative to the base frame system 104. This may, for example, provide dampening that enhances the ability of the field screen 100 to absorb impacts to the screen frame system 102, such as impacts of baseballs, golf balls, lacrosse balls, footballs, basketballs, or other sports balls with the screen frame system 102.

The body relative directions referred to here are intended to provide an understanding of the relative locations of components of the field screen 100. In accordance with the coordinate system axes illustrated in the figures (unless indicated otherwise), "left" may refer to the positive "x" direction, "right" may refer to the negative "x" direction, "front" (or "forward") may refer to the positive "y" direction, "back" (or "rearward") may refer to the negative "y" direction, "up" (or "upward") may refer to the positive "z" direction (e.g., away from the ground), and "down" (or "downward") may refer to the negative "z" direction (e.g., toward the ground). "Lateral" may refer to orientation or movement in the x direction. "Longitudinal" may refer to orientation or movement in the y-direction. "Vertical" may refer to orientation or movement in the z-direction.

The screen frame system 102 may be a structure that provides a physical barrier that is operable to absorb impacts of sports balls and other objects. In some embodiments, the screen frame system 102 includes a screen frame 110 and a protective screen 112. In some embodiments, the screen frame 110 defines an opening 114 (e.g., a rectangular opening) and the protective screen 112 spans some or all of the opening 114. During use, the protective screen 112 may inhibit sports balls or other object frame passing through the area defined by the opening 114. For example, referring to FIG. 1A, the screen frame 110 may define a rectangular shaped opening 114 that is covered by the protective screen 112 such that the protective screen 112 inhibits sports balls or other objects from passing through the rectangular area of the opening 114.

In some embodiments, the protective screen 112 includes a netting. For example, the protective screen 112 may be a flexible mesh style netting formed of nylon high density polyethylene (HDPE), rubber, or the like. The protective screen 112 may be secured to the screen frame 110, for example, by way of clips or similar fasteners. During use, the protective screen 112 may, for example, absorb the impacts of sports balls or other objects to inhibit the balls from hitting a person or other object protected by the field screen 100.

In some embodiments, the screen frame 110 is a rigid structure that supports the protective screen 112. For example, the screen frame 110 may be formed of one or more rigid screen frame members 120 that define an opening 114 and are capable of supporting a protective screen 112 that spans some or all of the opening 114. For example, in the illustrated embodiment, the screen frame 110 includes a screen frame upper member 122 (e.g., formed of individual screen frame upper members 122*a*-122*d* fastened to one another), a screen frame lower member 124 (e.g., formed of individual right and left screen frame lower members 124*a* and 124*b*), and screen frame arm members 128 (e.g., right and left screen frame arm members 128*a* and 128*b*). In some embodiments, the members of the screen frame 110 are formed of round or square tubing. For example, each of the screen frame members 120 may be formed of 1.5 inch×1.5 inch steel square tubing. In some embodiments, the respective members of the screen frame 110 are coupled to one another by way of welds or fasteners.

In some embodiments, the screen frame upper members 122 and the screen frame lower members 124 define the opening 114 that is covered by the protective screen 112. For example, in the illustrated embodiment, the screen frame upper member 122 and the screen frame lower member 124, together, define the rectangular shaped opening 114 that extends laterally and vertically (e.g., in the x-z plane) and that is covered by the protective screen 112.

In some embodiments, the screen frame arm members 128 facilitate coupling of the screen frame system 102 to the frame dampening system 106. For example, in the illustrated embodiment, each of the screen frame arm members 128 are coupled to a lower portion of the screen frame 110 and are oriented transverse to the planar opening 114 (e.g., oriented in the y direction) such that they define respective screen frame arms 128 (e.g., right and left screen frame arms 128*a* and 128*b*) that extend longitudinally from the lower portion of the screen frame 110, in front of the opening 114 and the protective screen 112 (e.g., in the positive y direction) and behind the opening 114 and the protective screen 112 (e.g., in the negative y direction). As described here, in some embodiments, resilient members of the frame dampening system 106 are disposed between the screen frame arm members 128 and complementary portions of the base frame system 104 to facilitate movement of the screen frame system 102 relative to the base frame system 104.

The base frame system 104 may be a structure that supports positioning of the screen frame system 102 above a supporting surface (e.g., above the ground). In some embodiments, the base frame system 104 includes base frame feet 140 (e.g., right and left base frame feet 140*a* and 140*b*). In some embodiments, the base frame feet 140 are rigid structures that are operable to support the screen frame 110 in a desired (e.g., upright/vertical) positon. For example, the base frame feet 140 may support the screen frame 110 in the illustrated upright/vertical positon that includes the upper portion of the screen frame 110 disposed in the x-z plane.

In some embodiments, the base frame feet 140 extend transverse to the screen frame 110 to support the screen frame 110 in an upright/vertical positon. For example, in the illustrated embodiments, each of the base frame feet 140 are located directly under the respective screen frame arms 128 and are oriented transverse to the planar opening 114 (e.g., oriented in the y direction) such that they define respective base frame feet 140 (e.g., right and left base frame feet 140*a* and 140*b*) that extend longitudinally in front of the opening 114 and the protective screen 112 (e.g., in the positive y direction) and behind the opening 114 and the protective screen 112 (e.g., in the negative y direction). The arrangement of the base frame feet 140 in front of and behind the screen frame 110 may facilitate holding of the screen frame 110 in a desired (e.g., upright/vertical) positon and inhibit the screen frame 110 from falling forward or backward while not in use or in the event the screen frame 110 is struck by a ball or other object.

Each of the base frame feet 140 may be formed of one or more rigid base frame members 142 that define a footing that is capable of supporting the screen frame 110 in a desired positon. For example, in the illustrated embodiments of FIGS. 1A-3F, each of the base frame feet 140*a* and 140*b* includes a base frame foot member 144 and wing members 146 (e.g., inside and outside wing members 146*a* and 146*b*). Each base frame foot member 144 includes an elongated member that is located directly under a respective one of the screen frame arms 128 and that extends longitudinally in front of the opening 114 and the protective screen 112 (e.g., in the positive y direction) and behind the opening 114 and the protective screen 112 (e.g., in the negative y direction). Each of the wing members 146 includes a member that extends laterally (e.g., right or left) of the respective base frame foot member 144 to which it is attached. In some embodiments, the members of the base frame feet 140 are formed of round or square/rectangular tubing. For example, each of the base frame members 142 may be formed of 1.5 inch×1.5 inch steel square tubing. In some embodiments, the respective members of the base frame feet 140 are attached to one another (e.g., by way of welds or fasteners).

The longitudinal extension of the base frame members 142 in front of and behind the laterally oriented screen frame 110 may facilitate holding of the screen frame 110 in a desired positon, such as the generally upright/vertical (or "standing") position, and inhibit the screen frame 110 from falling forward or backward in the event the screen frame 110 is struck by a ball or other object. The lateral extension of the wing members 146 from the base frame foot members 144 may inhibit each of the base frame feet 140 from "rolling over" sideways (e.g., rotating about a longitudinal axis of the associated base frame foot member 144), such as during assembly of the field screen 100 while the base frame feet 140 are not held in positon by the screen frame 110, and may enhance the general support and stability of the base frame foot members 144 and the assembled field screen 100. As described here, in some embodiments, resilient members 150 of the frame dampening system 106 are disposed between base frame foot members 144 and complementary portions of the screen frame system 102 to facilitate movement of the screen frame system 102 relative to the base frame system 104.

The frame dampening system 106 may facilitate movement (e.g., pivoting) of the screen frame system 102 relative to the base frame system 104. In some embodiments, the frame dampening system 106 includes one or more resilient members 150 that are disposed between the screen frame system 102 and the base frame system 104. Each resilient member 150 may be coupled to a portion of the screen frame system 102 and a complementary portion of the base frame system 104 such that the screen frame system 102 is coupled to the base frame system 104 by way of the resilient members 150. For example, one or more resilient members 150 may be disposed between (and be coupled to) some or all of the following pairs of frame portions: (1) a front portion 152 of the right screen frame arm 128*a* and a front portion 154 of the base frame foot member 144 of the right base frame foot 140*a*; (2) a front portion 152 of the left screen frame arm 128*b* and a front portion 154 of the base frame foot member 144 of the left base frame foot 140*b*; (3) a back portion 156 of the right screen frame arm 128*a* and a back portion 158 of the base frame foot member 144 of the right base frame foot 140*a*; and (4) a back portion 156 of the left screen frame arm 128*b* and a back portion 158 of the base frame foot member 144 of the left base frame foot 140*b*.

For example, referring to the detailed view of FIGS. 1E and 1F, in the illustrated embodiment, the depicted portion of the frame dampening system 106 includes a "front-right" resilient member 150 disposed between an underside/face of the front portion 152 of the right screen frame arm 128*a* and an upper side/face of the front portion 154 of the base frame foot member 144 of the right base frame foot 140*a*, and a "back-right" resilient member 150 disposed between an underside/face of the back portion 156 of the right screen frame arm 128*a* and an upper side of the back portion 158 of the base frame foot member 144 of the right base frame foot 140*a*. Each of the resilient members 150 may be fastened to the right screen frame arm 128*a* and the base frame foot member 144 by way of respective fasteners 160 (e.g., bolt type fasteners).

During use, the resilient members 150 may provide a restoring force in response to being deformed. For example, in the event the front portion 152 of the right screen frame arm 128*a* moves upward/away from the front portion 154 of the base frame foot member 144 of the right base frame foot 140*a* (as indicated by arrow 170), the "front-right" resilient member 150 may be placed in tension and, in turn, generate a restoring force (as indicated by arrow 172) that pulls the front portion 152 of the right screen frame arm 128*a* downward/toward the front portion 154 of the base frame foot member 144 of the right base frame foot 140*a*. In the event the back portion 156 of the right screen frame arm 128*a* moves downward/toward the back portion 158 of the base frame foot member 144 of the right base frame foot 140*a* (as indicated by arrow 174), the "back-right" resilient member 150 may be placed in compression and, in turn, generate a restoring force (as indicated by arrow 176) that pushes the back portion 156 of the right screen frame arm 128*a* upward/away from the front portion 154 of the base frame foot member 144 of the right base frame foot 140*a*. Accordingly, in some embodiments, the front and back resilient members 150 act in coordination to facilitate and regulate movement (e.g., pivoting) of the screen frame 110 relative to the base frame system 104 and to provide a restoring force that urges (or "biases") the screen frame 110 to return to a given position. As an example, in the event the screen frame 110 is held in a standing position (e.g., a generally vertical/upright orientation, as shown) and a ball or other object traveling in the direction of arrow 180 (e.g., in the negative y direction) strikes the front side of the screen frame system 102 (e.g., a front side of the screen frame 110 or a front side of the protective screen 112), the impact may generate a force/torque on the screen frame (as indicated by arrow 182) that causes tensioning of the "front-right" resilient member 150 (as indicated by arrow 170) and compression of the "back-right" resilient member 150 (as indicated by arrow 174). As a result, the "front-right" resilient member 150 (now in tension) may generate a restoring force (as indicated by arrow 172) that pulls the front portion 152 of the right screen frame arm 128*a* downward/toward the front portion 154 of the base frame foot member 144 of the right base frame foot 140*a*, and the "back-right" resilient member 150 (now in compression) may generate a restoring force (as indicated by arrow 176) that pushes the back portion 156 of the right screen frame arm 128*a* upward/away from the back portion 158 of the base frame foot member 144 of the right base frame foot 140*a*. The resulting deformation (e.g., the elongation and compression) of the resilient members 150 may cause the screen frame 110 (and the protective screen 112) to pivot (or "tilt") backward relative to the base frame system 104. The movement may include pivoting movement of the screen frame 110 (and the protective screen 112) about a lateral oriented pivot axis 184 (e.g., an axis oriented in the x direction) (as indicated by arrow 186). In some embodiments, the deformation may include an element of horizontal shear that causes longitudinal movement of the screen frame 110 (and the protective screen 112) (e.g., in the negative y direction) (as indicated by arrow 188) relative to the base frame system 104. Further, the restoring forces provided by the deformation of the resilient members 150 may urge (or "bias") the screen frame 110 (and the protective screen 112) back to the vertical/upright orientation.

In some embodiments, the screen frame arms 128 include stop members 190 that are configured to limit movement of the screen frame 110 (and the protective screen 112). For example, a stop members 190 may include a member that extend downward from a respective screen frame arm 128 and that is positioned to engage a complementary portion of the base frame foot member 144 to limit movement of the screen frame 110 (and the protective screen 112) relative to the base frame system 104.

In some embodiments, the resilient members 150 are longitudinally offset from one another by a distance ($D_1$) in the range of about 6-24 inches (e.g., $D_1$ may be about 12 inches) (see, e.g., FIG. 1F). In some embodiments, the resilient members 150 are longitudinally offset from the screen frame 110 by a distance ($D_2$ or $D_3$) in the range of about 3-12 inches (e.g., $D_2$ and/or $D_3$ may be about 6 inches) (see, e.g., FIG. 1F). In some embodiments, the base frame feet 140 have a length ($L_1$) in the range of about 2-6 feet (e.g., $L_1$ may be about 54 inches) (see, e.g., FIG. 1D).

Although a right side of the field screen 100 is depicted and described with regard to FIGS. 1E and 1F for the purpose of illustration, the opposite side (e.g., the left side of the field screen 100) may incorporate the same or similar elements (e.g., the left side of the field screen 100 may be a mirror image of the illustrated right side of the field screen 100). These "left" elements may provide similar functions to their "right" counterparts. For example, "left-front" and "left-back" resilient members 150 may deform and provide restorative biasing forces in a manner similar to that described here with regard to the respective "right-front" and "right-back" resilient members 150. Although a rectangular shaped screen frame 110 is depicted and described with regard to FIGS. 1A-1F for the purpose of illustration, the screen frame 110 may embody other shapes and sizes. For example, FIGS. 2A-2D illustrate an "L" (or "pitching") type field screen 100 having L-shaped screen frame 110 (each may have similar components to embodiments of the field screen 100 described with regard to FIGS. 1A-1F). An L-type field screen 100 may, for example, be placed in front of a person (or machine) throwing (or "pitching") baseballs to a batter to protect the person (or the machine) from balls struck (or "hit") by the batter.

Figure 4A:
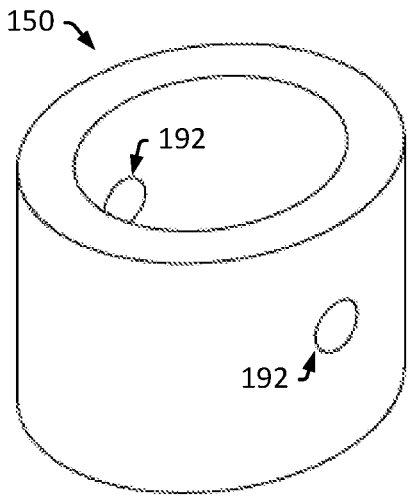
FIGS. 4A-4C are diagrams that illustrate a resilient element in accordance with one or more embodiments.
Figure 4B:
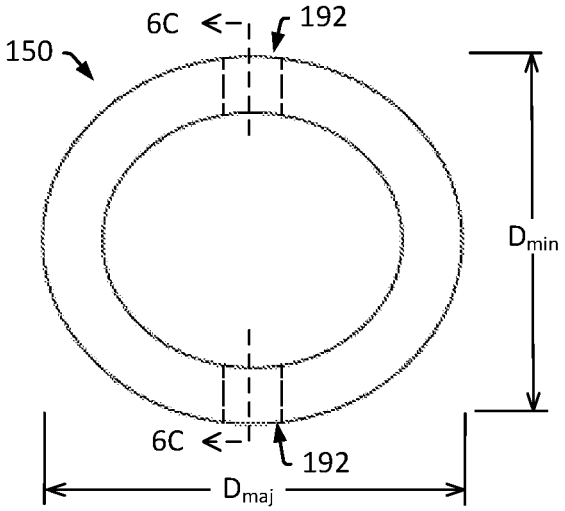
Figure 4C:
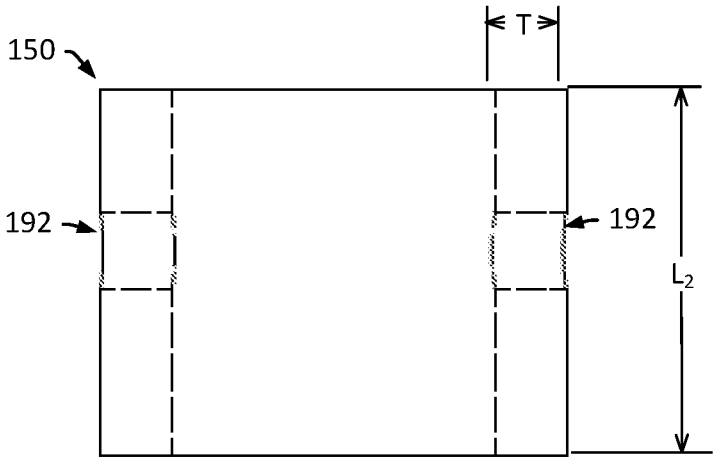

Embodiments may employ alternative components to those described with regard to FIGS. 1A-1F. For example, FIGS. 3A-F illustrate an L-type field screen 100 having L-shaped screen frame 110 an employing an alternative arrangement of the screen frame arm members 128 and the base frame feet 140. The screen frame arm members 128 depicted in FIGS. 3A-3F do not include stop members. The wing members 146 include members that extend laterally from the end of the base frame foot members 144. Although an L-shaped screen frame 110 is depicted and described with regard to FIGS. 3A-F for the purpose of illustration, the screen frame 110 may embody other shapes and sizes (e.g., a rectangular shape) in combination with the alternative arrangement of the screen frame arm members 128 and the base frame feet 140. In some embodiments, each of the resilient members 150 includes a hollow, oval shaped member formed of an elastomeric material. FIGS. 4A-4C illustrate perspective, side and section views of a resilient member 150 in accordance with one or more embodiments. In some embodiments, the resilient member 150 has a major external diameter ($D_{maj}$) of about 3 inches (e.g., 2.6 inches), a minor external diameter ($D_{min}$) of about 2 inches (e.g., 2.3 inches), a thickness (T) of about 0.5 inches (e.g., 0.4 inches), and a length ($L_2$) of about 1.8 inches. The resilient member 150 may, for example, have mounting holes 192 that accept respective top and bottom fasteners 160 that couple to the screen frame arm members 128 and the base frame feet 140, respectively.

In some embodiments, the described base frame feet 140 employ one or more recesses into which the resilient members 150 are disposed and mounted. For example, FIGS. 5A-5D illustrate an embodiment in which the base frame feet 140 have recesses 200 into which respective ones of the resilient members 150 are disposed and mounted. Such a "recessed-foot" type mounting configuration may help to protect the resilient members 150 from damage and, thereby, help to extend the useful life of the resilient members 150 of the field screen 100. For example, at least a lower portion of the resilient members 150 disposed "inside" the recesses 200 may be shielded from contact with persons, balls or other objects, which can help to reduce wear and tear on the resilient members 150. Further, the proximity of the edges of recesses 200 (e.g., the edges of the rectangular cutouts 206 in the upper wall 208 of the tubing 20) and resulting physical contact of the resilient members 150 with the edges may limit deformation of the resilient members 150 (e.g., prevent over extension of the resilient members 150), which can help to limit damage and general wear and tear on the resilient members 150.

In some embodiments, the recesses 200 provide for a lower surface of a resilient member 200 being disposed below an upper surface of the base frame feet 140. For example, in the illustrated embodiments of FIGS. 5A-5F, the base frame foot member 144 is formed of a rectangular tubing 201 having two recesses 200 for receiving respective first ("front") and second ("back") resilient members 150 that are mounted to an interior surface 202 of lower wall 204 of the tubing 201. Each of the recesses 200 is defined by a cuboid shaped void region 205 made accessible by way of a rectangular cutout 206 formed in an upper wall 208 of the tubing. As seen in at least FIGS. 5A, 5B and 5E, A lower surface of the resilient member 150 is disposed against an upper surface of the lower wall 204 of the tubing 201 such that the resilient member 150 disposed within the recesses 200 and associated void region 205 and the lower surface of a resilient member 200 is disposed below the upper surface of the base frame foot member 144. The resilient member 150 is mounted to the tubing 201 by way of a fastener 208, including a bolt 210 and nut 212, secured through a lower mounting hole 192 of the resilient member 150 and a complementary mounting hole 214 that extends through the lower wall 204 of the tubing 201.

Figure 5A:
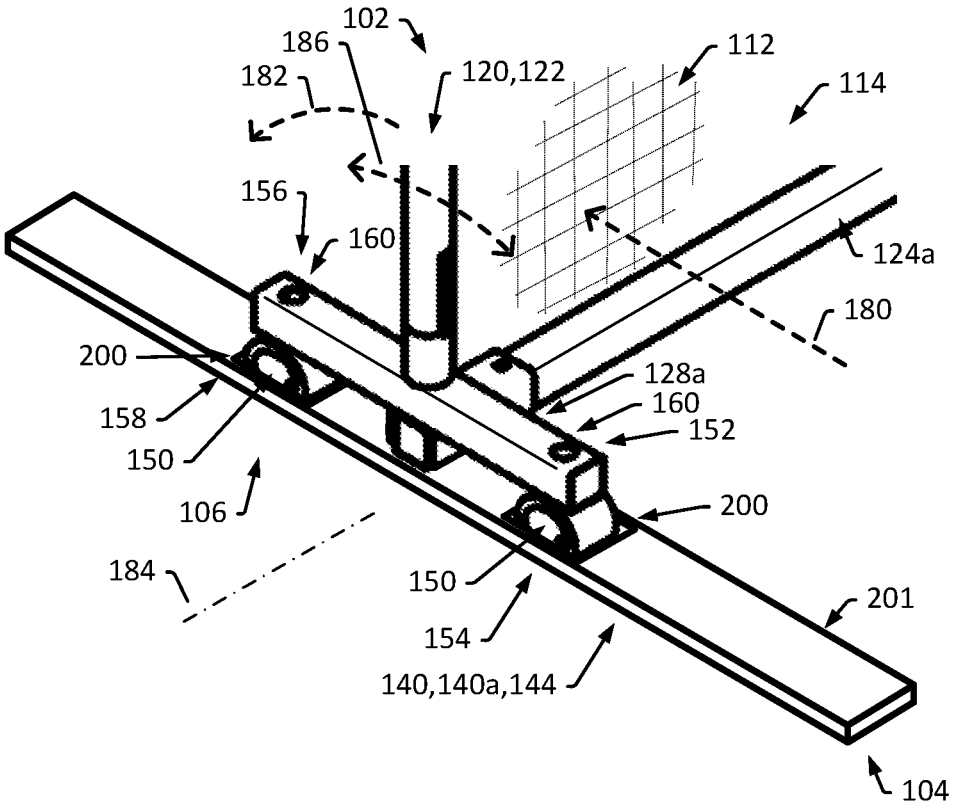
FIGS. 5A-5F are diagrams that illustrate elements of a base fame system in accordance with one or more embodiments.
Figure 5B:
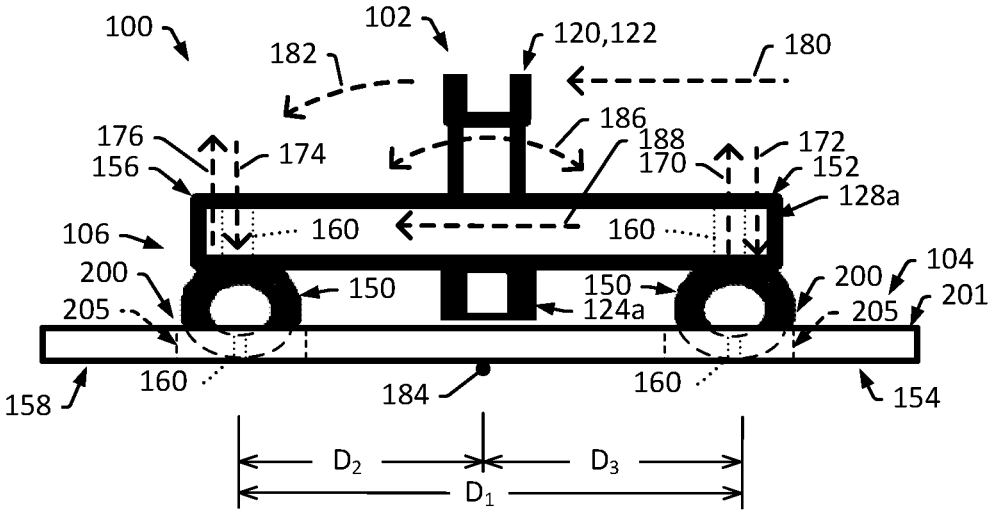
Figure 5C:
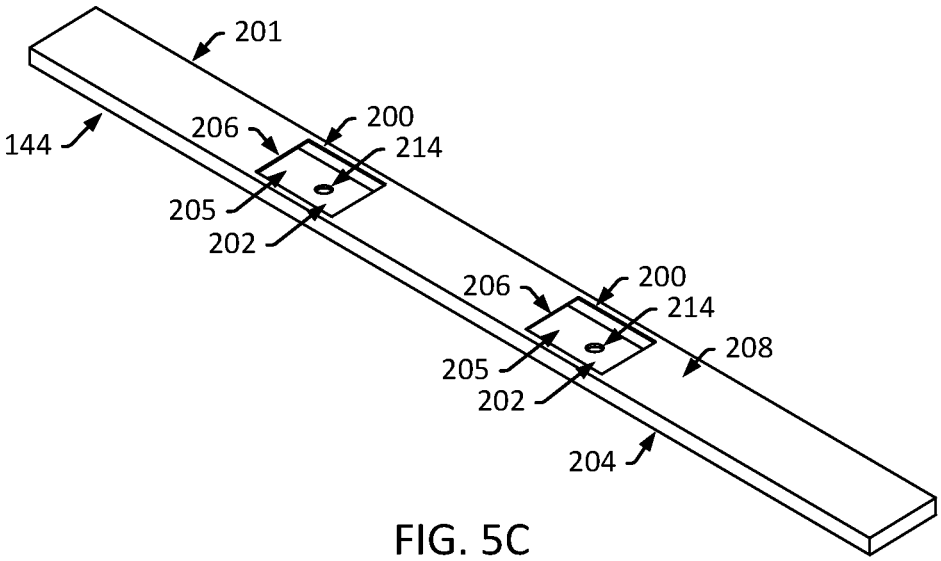
Figure 5D:
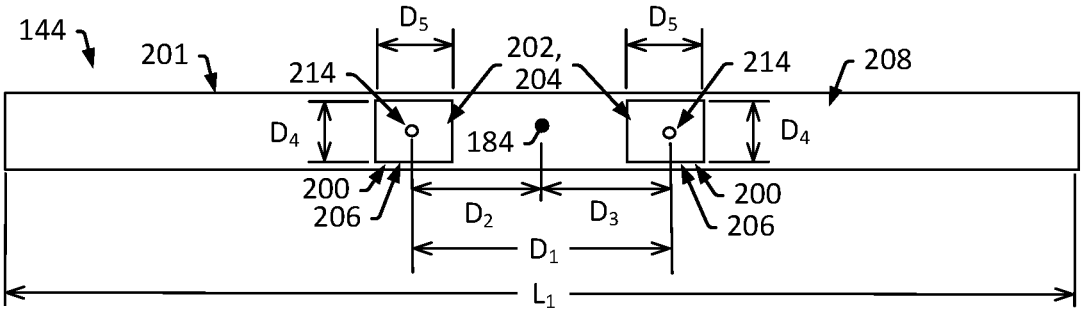
Figure 5E:
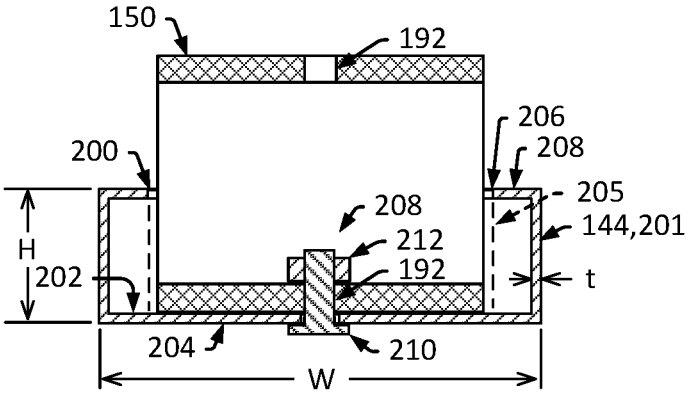
Figure 5F:
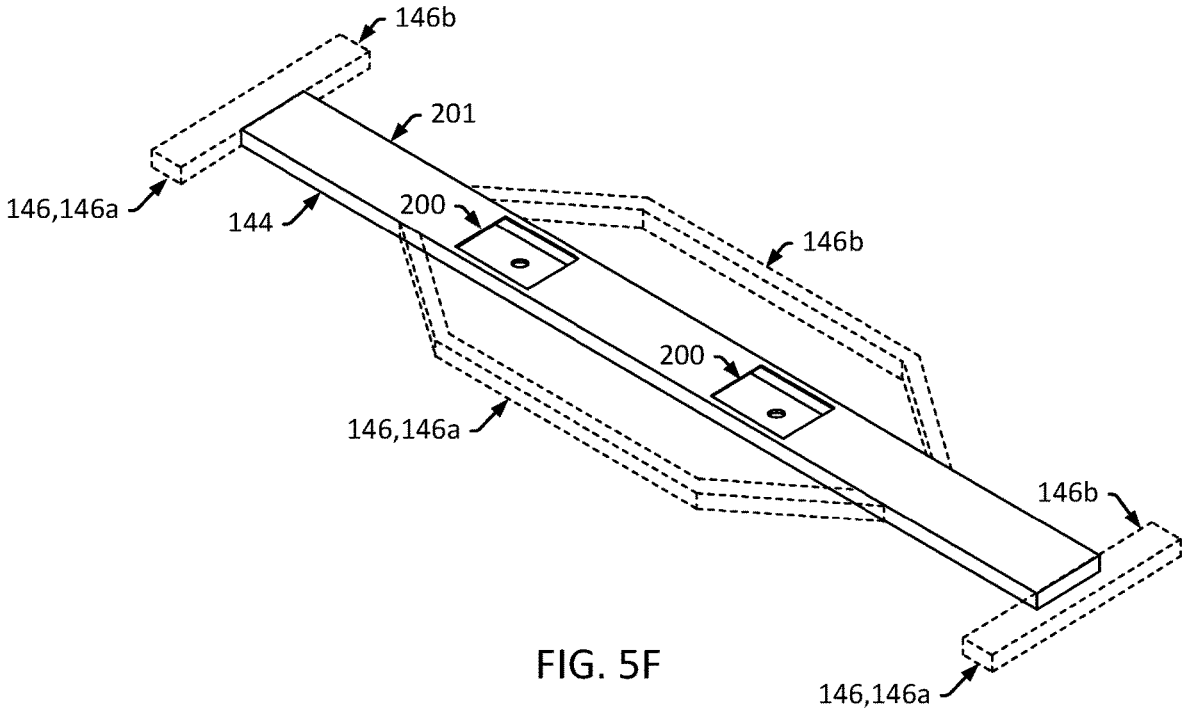

Similar to the other described embodiments (and as illustrated in FIGS. 5A and 5B, which have numbering that corresponds to earlier descriptions), the front and back resilient members 150 disposed in the recesses 200 may act in coordination to facilitate and regulate movement (e.g., pivoting) of the screen frame 110 relative to the base frame system 104 and to provide a restoring force that urges (or "biases") the screen frame 110 to return to a given (e.g., upright) position.

In some embodiments, the resilient members are located at positions similar those described with regard to other embodiments (e.g., $D_1$ is equal to or about 12 inches, $D_2$ and/or $D_3$ are equal to or about 6 inches), and the feet 144 may be similarly sized (e.g., $L_1$ is equal to or about 54 inches). In some embodiments, the cutouts 206 have a length ($D_4$) that is about the same or greater than the length ($L_2$) of the resilient member 150 (e.g., $D_4$ is equal to or about 2.25 inches) and the cutouts 206 have a width ($D_5$) that is about the same or greater than the major external diameter ($D_{maj}$) of the resilient member 150 (e.g., $D_5$ is equal to or about 3 inches) (see, e.g., FIG. 5D). In some embodiments, the rectangular tubing 201 may have a height (H) of about 0.5-2 inches (e.g., H is equal to or about 1 inch), a width (W) of about 2-4 inches (e.g., W is equal to or about 3 inches) and a wall thickness (t) equal to or about 0.08 inches (see, e.g., FIG. 5E).

Although a right side of the field screen 100 is depicted and described with regard to FIG. 5A for the purpose of illustration, the opposite side (e.g., the left side of the field screen 100) may incorporate the same or similar elements (e.g., the left side of the field screen 100 may be a mirror image of the illustrated right side of the field screen 100). These "left" elements may provide similar functions to their "right" counterparts. For example, the "left-front" and "left-back" resilient members 150 may deform and provide restorative biasing forces in a manner similar to that described here with regard to the respective "right-front" and "right-back" resilient members 150. Further, the "recessed-foot" type base frame feet may be incorporated with other embodiments described herein. For example, lateral wing members 146 (e.g., some or all of those depicted and described with regard to FIGS. 1A-3E) may be used in conjunction with the "recessed-foot" type base frame feet, as illustrated by the dashed lines of FIG. 5F. Further, screen frame arms having stop members (e.g., such as those described in FIGS. 1A-2D) may be employed in conjunction with the described "recessed-foot" type base frame feet. For example, the "recessed-foot" type base frame feet 140 of FIGS. 5A and 5B may be used in place of the feet 140 of FIGS. 1E and 1F (e.g., to limit movement of the screen frame 110 and the protective screen 112 relative to components of the base frame system 104). Further modifications and alternative embodiments of various aspects of the disclosure will be apparent to those skilled in the art in view of this description. Accordingly, this description is to be construed as illustrative and for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to limit the scope of the description.

As used throughout this application, the word "may" is used in a permissive sense (e.g., meaning having the potential to), rather than the mandatory sense (e.g., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A, B or C may refer to the element including A, B, and C, A and B, A and C, B and C, or A, B and C.

What is claimed is:

1. A field screen system, comprising:

a screen frame system comprising:

a screen frame; and a screen coupled to the screen frame;

a base frame configured to be disposed on a supporting surface; and resilient members, the screen frame coupled to the base frame by way of the resilient members, and the resilient members configured to deform to enable pivoting of the screen frame relative to the base frame, the screen frame comprising:

a planar screen frame configured to support the screen; and a first screen frame arm member oriented transverse to the planar screen frame, the first screen frame arm member comprising a first portion that extends on a first side of the planar screen frame and a second portion that extends on a second side of the planar screen frame, the base frame comprising:

a first base frame foot member oriented transverse to the planar screen frame, the first base frame foot member comprising a first portion that extends on the first side of the planar screen frame and a second portion that extends on the second side of the planar screen frame, and the resilient members comprising:

a first resilient member disposed between the first portion of the first screen frame arm member and the first portion of the first base frame foot member, and a second resilient member of the resilient members is disposed between the second portion of the first screen frame arm member and the second portion of the first base frame foot member.

2. The sysem of claim 1, wherein the screen frame comprises:

a second screen frame arm member oriented transverse to the planar screen frame, wherein a resilient member of the resilient members is disposed between the second screen frame arm member and the base frame.

3. The system of claim 1, wherein the screen frame further comprises:

a second screen frame arm member oriented transverse to the planar screen frame, the second screen frame arm member comprising a first portion that extends on the first side of the planar screen frame and a second portion that extends on the second side of the planar screen frame;

wherein the base frame further comprises:

a second base frame foot member oriented transverse to the planar screen frame, the second base frame foot member comprising a first portion that extends on the first side of the planar screen frame and a second portion that extends on the second side of the planar screen frame, wherein a third resilient member of the resilient members is disposed between the first portion of the second screen frame arm member and the first portion of the second base frame foot member, and wherein a fourth resilient member of the resilient members is disposed between the second portion of the second screen frame arm member and the second portion of the second base frame foot member.

4. The system of claim 1, wherein each of the resilient members is formed of an elastomeric material.

5. The system of claim 1, wherein each of the resilient members comprises a hollow, oval-shaped member formed of an elastomeric material.

6. The system of claim 1, wherein the screen comprises a netting.

7. The system of claim 1, wherein the screen comprises a flexible mesh.

8. The system of claim 1, wherein the screen frame defines an opening that is covered by the screen.

9. The system of claim 1, wherein the screen frame comprises an L-shaped screen frame that defines an L-shaped opening that is covered by the screen.

10. The system of claim 1, wherein the screen frame comprises a rectangular shaped screen frame that defines a rectangular opening that is covered by the screen.

11. A field screen system, comprising:

a screen frame configured to support a screen;

a base frame configured to be disposed on a supporting surface; and resilient members configured to couple the screen frame to the base frame, the resilient members configured to deform to enable movement of the screen frame relative to the base frame, the screen frame comprising:

a planar screen frame configured to support the screen; and a first screen frame arm member oriented transverse to the planar screen frame, the first screen frame arm member comprising a first portion that is configured to extend on a first side of the planar screen frame and a second portion that is configured to extend on a second side of the planar screen frame, the base frame comprising:

a first base frame foot member oriented transverse to the planar screen frame, the first base frame foot member comprising a first portion that is configured to extend on the first side of the planar screen frame and a second portion that is configured to extend on the second side of the planar screen frame, the resilient members comprising:

a first resilient member configured to be disposed between the first portion of the first screen frame arm member and the first portion of the first base frame foot member, and a second resilient member configured to be disposed between the second portion of the first screen frame arm member and the second portion of the first base frame foot member.

12. The system of claim 11, wherein the screen frame comprises:

a second screen frame arm member oriented transverse to the planar screen frame, wherein a resilient member of the resilient members is disposed between the second screen frame arm member and the base frame.

13. The system of claim 11, wherein the screen frame further comprises:

a second screen frame arm member oriented transverse to the planar screen frame, the second screen frame arm member comprising a first portion that is configured to extend on the first side of the planar screen frame and a second portion that is configured to extend on the second side of the planar screen frame;

wherein the base frame further comprises:

a second base frame foot member oriented transverse to the planar screen frame, the second base frame foot member comprising a first portion that is configured to extend on the first side of the planar screen frame and a second portion that is configured to extend on the second side of the planar screen frame, wherein a third resilient member of the resilient members is configured to be disposed between the first portion of the second screen frame arm member and the first portion of the second base frame foot member, and wherein a fourth resilient member of the resilient members is configured to be disposed between the second portion of the second screen frame arm member and the second portion of the second base frame foot member.

14. The system of claim 11, wherein the resilient members are configured to deform to enable pivoting of the screen frame relative to the base frame.

15. The system of claim 11, wherein each of the resilient members is formed of an elastomeric material.

16. The system of claim 11, wherein each of the resilient members comprises a hollow, oval-shaped member formed of an elastomeric material.

17. The system of claim 11, further comprising the screen, wherein the screen comprises a netting.

18. The system of claim 11, further comprising the screen, wherein the screen comprises a flexible mesh.

19. The system of claim 11, wherein the screen frame defines an opening that is configured to be covered by the screen.

20. The system of claim 11, wherein the screen frame comprises an L-shaped screen frame that defines an L-shaped opening that is configured to be covered by the screen.

21. The system of claim 11, wherein the screen frame comprises a rectangular shaped screen frame that defines a rectangular opening that is configured to be covered by the screen.

22. The system of claim 11, wherein the screen is coupled to the screen frame, and the screen frame is coupled to the base frame by way of the resilient members.

* * * * *